US008952302B2

(12) United States Patent
Park

(10) Patent No.: US 8,952,302 B2
(45) Date of Patent: Feb. 10, 2015

(54) CERAMIC-COATED HEATER WHICH CAN BE USED IN WATER OR AIR

(75) Inventor: Chung Kwon Park, Busan (KR)

(73) Assignee: Thermolon Korea Co., Ltd., Gangseo-gu, Busan (KR)

( * ) Notice: Subject to any disclaimer, the term of this patent is extended or adjusted under 35 U.S.C. 154(b) by 765 days.

(21) Appl. No.: 13/145,867

(22) PCT Filed: Dec. 1, 2009

(86) PCT No.: PCT/KR2009/007106
§ 371 (c)(1),
(2), (4) Date: Jul. 22, 2011

(87) PCT Pub. No.: WO2010/090389
PCT Pub. Date: Aug. 12, 2010

(65) Prior Publication Data

US 2011/0278283 A1 Nov. 17, 2011

(30) Foreign Application Priority Data

Feb. 3, 2009 (KR) ..... 10-2009-0008642

(51) Int. Cl.
*H05B 3/10* (2006.01)
*H05B 3/02* (2006.01)
(Continued)

(52) U.S. Cl.
CPC *H05B 3/80* (2013.01); *D06F 25/00* (2013.01); *D06F 39/04* (2013.01); *D06F 58/26* (2013.01); *D06F 75/24* (2013.01); *H05B 3/48* (2013.01)
USPC ..... 219/548; 219/538; 219/539; 219/540; 219/552; 219/553; 219/542; 219/543; 219/544; 219/545; 219/546; 219/547; 219/549; 219/550; 219/551; 392/311; 392/338; 392/497; 392/500; 252/500; 252/501.1; 252/502; 252/512; 252/516; 252/518.1; 252/519.1; 252/519.14; 252/519.21; 252/519.3; 252/519.31; 252/519.32; 252/519.33; 252/519.34

(58) Field of Classification Search
CPC ..... H05B 2203/02; F01M 5/021; G02F 1/13452; H01L 21/288; C03C 17/30; D06M 13/513; C14C 9/00; C07F 7/10; D06F 37/42; E05B 17/22; E05B 47/0009; E05C 19/02
USPC ..... 219/548, 552–553, 538–551, 219/145.1–145.41, 146.1, 146.21–146.52, 219/149, 156; 392/311–338, 497–503
See application file for complete search history.

(56) References Cited

U.S. PATENT DOCUMENTS 2,745,928 A * 5/1956 Glaser ..... 338/332
3,010,157 A * 11/1961 Cizek ..... 264/53
(Continued)

FOREIGN PATENT DOCUMENTS

JP 06-191970 A 7/1994
JP 2006-026976 2/2006
(Continued)

*Primary Examiner* — Dana Ross
*Assistant Examiner* — Gyounghyun Bae
(74) *Attorney, Agent, or Firm* — John K. Park; Park Law Firm

(57) ABSTRACT

The present invention relates to a ceramic-coated heater in which the outer surface of a heater rod is coated with ceramic to improve the physical properties thereof including durability, corrosion resistance, and the like, thereby enabling the heater to be used in water or air. The outer surface of the heater rod is coated with a ceramic composition to which an acrylic corrosion resistant wax is added, thereby strengthening the bonding force of the coating layer film, and thus improving the physical properties thereof including durability, corrosion resistance, and the like to enable the heater to be used in water. Therefore, the ceramic-coated heater of the present invention enables high thermal conductivity using less current and reduces energy consumption so that it can be utilized in a wide variety of industrial fields.

2 Claims, 2 Drawing Sheets

(51) Int. Cl.

| | |
|---|---|
| ***H05B 3/06*** | (2006.01) |
| ***H05B 3/16*** | (2006.01) |
| ***H05B 3/44*** | (2006.01) |
| ***H05B 3/34*** | (2006.01) |
| ***H05B 3/60*** | (2006.01) |
| ***H05B 3/40*** | (2006.01) |
| ***H05B 3/78*** | (2006.01) |
| ***H01B 1/00*** | (2006.01) |
| ***H01C 13/00*** | (2006.01) |
| ***H01B 1/04*** | (2006.01) |
| ***H01B 1/02*** | (2006.01) |
| ***H01B 1/12*** | (2006.01) |
| ***H05B 3/80*** | (2006.01) |
| ***D06F 25/00*** | (2006.01) |
| ***D06F 39/04*** | (2006.01) |
| ***D06F 58/26*** | (2006.01) |
| ***D06F 75/24*** | (2006.01) |
| ***H05B 3/48*** | (2006.01) |

(56) References Cited

U.S. PATENT DOCUMENTS

| | | | | | |
|---|---|---|---|---|---|
| 3,057,686 | A | * | 10/1962 | Muetterties | 423/347 |
| 3,111,569 | A | * | 11/1963 | Rubenstein | 52/223.14 |
| 3,359,525 | A | * | 12/1967 | Hubbuch | 338/308 |
| 3,467,686 | A | * | 9/1969 | Creamer | 556/410 |
| 3,736,285 | A | * | 5/1973 | Miller | 24/428 |
| 4,035,613 | A | * | 7/1977 | Sagawa et al. | 219/552 |
| 4,621,251 | A | * | 11/1986 | Keefe | 338/302 |
| 4,717,813 | A | * | 1/1988 | Berg et al. | 219/541 |
| 4,804,823 | A | * | 2/1989 | Okuda et al. | 219/553 |
| 4,855,570 | A | * | 8/1989 | Wang | 219/532 |
| 4,914,274 | A | * | 4/1990 | Hatanaka et al. | 219/270 |
| 4,914,751 | A | * | 4/1990 | Masaka et al. | 219/270 |
| 4,931,619 | A | * | 6/1990 | Ogata et al. | 219/270 |
| 5,317,132 | A | * | 5/1994 | Clough et al. | 219/543 |
| 5,526,462 | A | * | 6/1996 | Kondo et al. | 392/485 |
| 5,718,130 | A | * | 2/1998 | Kim | 68/19.2 |
| 5,834,742 | A | * | 11/1998 | Yoshida | 219/523 |
| 6,169,275 | B1 | * | 1/2001 | Noda et al. | 219/552 |
| 6,205,674 | B1 | * | 3/2001 | Kaizuka | 34/96 |
| 6,415,104 | B1 | * | 7/2002 | Fitts et al. | 392/503 |
| 6,483,079 | B2 | * | 11/2002 | Sato et al. | 219/270 |
| 6,828,032 | B2 | * | 12/2004 | Wielstra et al. | 428/448 |
| 7,619,187 | B2 | * | 11/2009 | Kim et al. | 219/553 |
| 2002/0043527 | A1 | * | 4/2002 | Ito | 219/444.1 |
| 2002/0102512 | A1 | * | 8/2002 | Yamaguchi | 432/258 |
| 2003/0042243 | A1 | * | 3/2003 | Taniguchi et al. | 219/270 |
| 2003/0209534 | A1 | * | 11/2003 | Ferguson | 219/548 |
| 2004/0200829 | A1 | * | 10/2004 | Hamburger et al. | 219/537 |
| 2006/0138123 | A1 | * | 6/2006 | Ishii et al. | 219/549 |
| 2006/0154468 | A1 | * | 7/2006 | Tanaka et al. | 438/613 |
| 2007/0209411 | A1 | * | 9/2007 | Lim et al. | 70/263 |
| 2009/0139036 | A1 | * | 6/2009 | Park | 8/149.3 |

FOREIGN PATENT DOCUMENTS

| | | | |
|---|---|---|---|
| KR | 10-2001-0056001 | A | 7/2001 |
| KR | 10-0518163 | B1 | 9/2005 |

* cited by examiner

CERAMIC-COATED HEATER WHICH CAN BE USED IN WATER OR AIR

TECHNICAL FIELD

The present invention relates to a ceramic-coated heater for enabling the combined use in water and air, and more particularly, to such a ceramic-coated heater in which the outer surface of a heater rod is coated with ceramic to improve the physical properties including wear resistance, corrosion resistance, heat resistance, and the like, thereby enabling the heater to be used in water or air, so that the heater can be applied to a variety of kinds of home electronic appliances including a washing machine, a coffee pot, a heater, and the like.

BACKGROUND ART

In general, a heater is a heat transfer means that permits current to flow into a conductor to dissipate heat from the conductor so as to heat fluid such as air or water. Such a heater is applied to a variety of kinds of home electronic appliance. For example, a heater used to heat water to boil it requires the physical properties such as corrosion resistance, wear resistance, and the like to prevent corrosion of the heater, and a heater used to heat air requires the outer surface of a heater rod to be coated with ceramic to improve the mechanical and chemical properties thereof to prevent oxidation of the heater in the air.

As such, as a representative example to which the heater is applied, a home electronic appliance, i.e., a washing machine employs a heater to supply hot water to increase the washability of clothes. In this case, since the washing machine uses a synthetic detergent containing various kinds of surfactants or the like, the heater rod of the heater is corroded and damaged or has scales formed on the surface thereof, resulting in occurrence of problems in that heat transfer is not performed smoothly to water to be used.

Such a conventional heater entails the above-mentioned problems, and in case of the heater for heating water to boil it as a solution to these problems, Korean Patent Laid-Out Publication No. 10-2003-37786 discloses a heater of a drum type washing machine which includes a hot wire disposed at the center thereof, a magnesium oxide layer configured to surround the outer circumference of the hot wire, and a stainless steel alloy layer configured to surround the outer circumference of the magnesium oxide layer, and a hard coating layer configured to surround the outer circumference of the stainless steel alloy layer. Such a heater is surface-treated to improve the physical properties including corrosion resistance, wear resistance, and the like. In addition, Korean Patent Laid-Out Publication No. 10-2000-2187 discloses an electric heater of a drum type washing machine in which an arrangement structure of the electric heater is modified within the washing machine to minimize the amount of washing water used and reduce the amount of power used. Further, Korean Utility Model Registration No. 20-393630 discloses a heater having a scale deposition preventive function in which the heater is coated with an inorganic-ceramic paint consisting of an inorganic binder solution prepared by adding a silica sol to a silane compound and stirring the mixture, a functional additive, a silicon oil polymer, and a water-soluble fluorine compound to prevent the disposition of scales on the heater. A variety of kinds of heaters as mentioned above have been developed and patent applications thereof have been filed. However, the heaters of these patents are suitable for heating water, but not for being used in the air. Specifically, in the case where fluorine resin is contained in a ceramic composition coated on the surface of a heater like the heater disclosed in Korean Utility Model Registration No. 20-393630, when the heater is heated to more than 260° C. in the air, the fluorine resin is decomposed due to low heat resistance, leading to a risk of damaging the coating film.

In addition, in case of the heater for heating air to dry the laundry, Korean Patent Laid-Out Publication No. 10-2005-66291 discloses a dry heater of a washing machine in which an insulator is configured to support a coil for generating heat. Such an electric heater, however, is a device in which electric current is supplied to the coil to generate heat from the coil and air receives heat from the heater while passing through the heater to produce high temperature and dry hot air. For this reason, the electric heater is technically limited to an arrangement structure of a heater to increase the dry efficiency.

The above conventional heaters, which have been used in the washing machine, have been developed so as to be suitable for their purpose in water or air. Also, heaters having the physical properties suited to the combined use in water and air have not been developed yet. As a solution to the above-mentioned problems, Korean Patent Laid-Out Publication No. 10-2005-97276 discloses a drum type washing machine with a single integrated heater in which a heater performing a function of doing laundering while boiling the laundry and a heater performing a function of drying the laundry are integrated into a single unit to simultaneously perform the both functions, thereby reducing the number of parts installed in the washing machine and the manufacturing cost, simplifying the structure of the washing machine, and saving the amount of washing water. As shown in FIG. 1, the drum type washing machine includes a cabinet 100 having a laundry inlet hole 12 formed at the front side thereof and a door 50 formed at the inlet hole 12 for opening and closing the inlet hole 12, a tub 20 mounted in the cabinet 10 for storing washing water therein, a driving motor 30 mounted below a bottom of the tub 10 for generating a driving force, a drum 40 mounted in the tub 20 and configured to be rotated by the driving force applied thereto from the driving motor 30, and a drying device 60 mounted at the inner upper portion of the cabinet 10 for circulating air in the interior of the drum 40 and removing moisture contained in the circulated air to dry a laundry received in the drum. In addition, the drum type washing machine further includes a heater 66 mounted in the drying device 60 to generate heat, and a water supply means 70 for supplying washing water to the inside of the drying device 60. Such a drum type washing machine has been developed and a patent application thereof has been filed. However, the integrated heater of the drum type washing machine is characterized in only a structure for mounting the integrated heater. Besides, since a material has not been developed which can satisfy the physical properties of the heater required to heat the heater in water or air, there is a limitation in its application.

DISCLOSURE OF INVENTION

Technical Problem

Accordingly, the present invention has been made to solve the problems occurring in the prior art and it is an object of the present invention to provide a ceramic-coated heater for enabling the combined use in water and air in which the outer surface of a heater rod is coated with a ceramic composition to which an acrylic corrosion resistant wax is added, thereby making the coating layer smooth and strengthening the bonding force of the coating layer film, and thus improving the physical properties thereof including durability, corrosion resistance, and the like to enable the heater to be used in water or air, so that the heater can be applied to a variety of home appliances including a drum type washing machine, a steam iron, a heater, and the like.

In case of a conventional heater having a ceramic fluorine resin coating layer formed thereon, there occurs no corrosion phenomenon in water owing to excellent corrosion resistance. Thus, although the heater is used in boiling water, its surface temperature does not exceed 100° C. As a result, there is caused no problem in the ceramic fluorine resin coating layer formed on the heater rod. On the other hand, in case where the heater coated with the ceramic fluorine resin is used in the air to heat air, a fluorine resin compound having a low heat resistance is decomposed at a temperature of 260° C. or higher, resulting in occurrence of a problem of damage of the coating layer film, and thus making the combined use of the hater in water and air impossible.

In addition, another object of the present invention is to provide a ceramic-coated heater for enabling the combined use in water and air in which the outer surface of a heater rod is coated with a ceramic composition to which high thermal conductive ceramic such as boron nitrate, β-alumina, zirconia, and the like and far infrared ray-radiating ceramic such as elvan, red clay, tourmaline, and the like are added, thereby improving thermal conductivity and wear resistance, and thus generating high energy using less current and reducing energy consumption. Therefore, the ceramic-coated heater of the present invention can be utilized in a wide variety of industrial fields.

Technical Solution

To achieve the above objects, in one aspect, the present invention provides a ceramic-coated heater for enabling the combined use in water and air, in which a heater rod has a ceramic coating layer formed on the outer surface thereof, the ceramic coating layer being coated with a ceramic coating composition, wherein the ceramic coating composition contains:

65 to 80 parts by weight of a binder consisting essentially of a silane compound and a silica sol;

18 to 30 parts by weight of a ceramic powder obtained by mixing a high thermal conductive ceramic and a far infrared ray-radiating ceramic;

1 to 3 parts by weight of an acrylic corrosion resistant wax; and 1 to 2 parts by weight of a pigment, wherein the parts by weight are based on 100 parts by weight of the composition.

Preferably, the binder consists of 50 to 70% by weight of a silane compound and 30 to 50% by weight of a silica sol, based on the total weight of the binder. Also, preferably, the silane compound is a binding agent for binding the ceramic powder, which is a silane represented by the formula $RnSiX_{4-n}$ or an oligomer derived therefrom.

In addition, preferably, the silica sol is a mixture obtained by adding a 60 to 80% by weight of water to 20 to 40% by weight of a powder silicon oxide having a particle size of from 0.2 to 1.0 μm.

Further, preferably, the ceramic powder is obtained by mixing 50 to 60% by weight of a high thermal conductive ceramic and 40 to 50% by weight of a far infrared ray-radiating ceramic, based on the total weight of the ceramic powder.

Advantageous Effects

According to the present invention, the outer surface of the heater rod is coated with a ceramic composition to which an acrylic corrosion resistant wax is added, thereby strengthening the bonding force of the coating layer film, and thus improving the physical properties thereof including durability, corrosion resistance, and the like to enable the heater to be used in water. In addition, the film of the coating layer is not decomposed even when the heater is heated to a temperature of 260° C. or higher to heat air, thereby enabling the combined use in water and air and thus the application of the heater to a variety of home appliances including a drum type washing machine, a steam iron, a heater, and the like. The outer surface of the heater of the present invention is coated with a ceramic composition obtained by mixing high thermal conductive ceramic such as boron nitrate, β-alumina and the like and far infrared ray-radiating ceramic, thereby improving thermal conductivity and wear resistance, and thus enabling high thermal conductivity using less current and reducing energy consumption. Therefore, the ceramic-coated heater of the present invention is expected to be utilized in a wide variety of industrial fields.

BEST MODE FOR CARRYING OUT THE INVENTION

Figure 1:
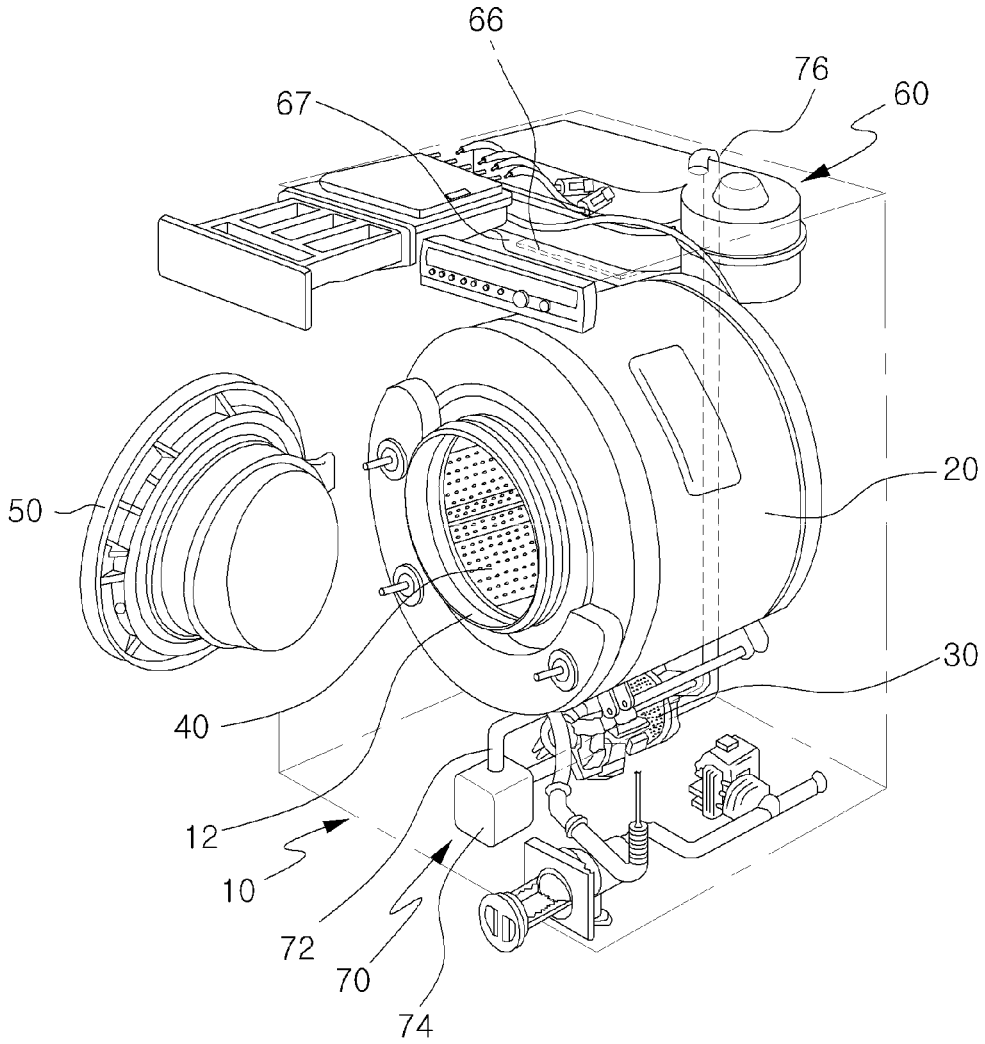
FIG. 1 is a perspective view illustrating a conventional drum type washing machine including an integrated heater which can be used in water or air.

Now, the preferred embodiments of the present invention will be described hereinafter in more detail with reference to FIGS. 1 to 3. In the meantime, in the detailed description and the accompanying drawings, the detailed description on either the construction which can be easily understood by those skilled in the art associated with the photovoltaic power generation industry or the elements and their operation which are not directly related with the technical characteristics of the present invention will be omitted.

Now, the construction of a ceramic-coated heater for enabling the combined use in water and air according to the present invention will be described hereinafter in more detail with reference to the accompanying drawings.

In the meantime, in the detailed description and the accompanying drawings, illustration and explanation on the construction and operation which a person skilled in the art can easily understand from a general heater will be briefly made or will be omitted to avoid redundancy. In particular, in the detailed description and the accompanying drawings, illustration and explanation on the detailed technical construction and operation of elements, which have no direct connection with the technical features of the present invention, will be omitted, and only the technical constructions directly related with the present invention will be briefly illustrated and explained.

Figure 2:
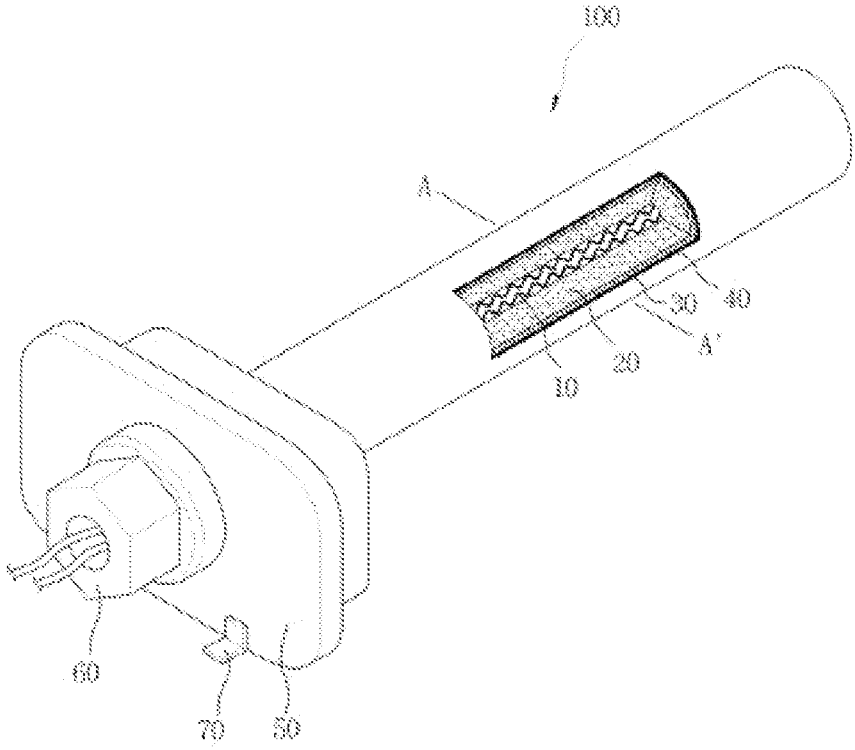
FIG. 2 is a perspective view illustrating a ceramic-coated heater for enabling the combined use in water and air according to the present invention.
Figure 3:
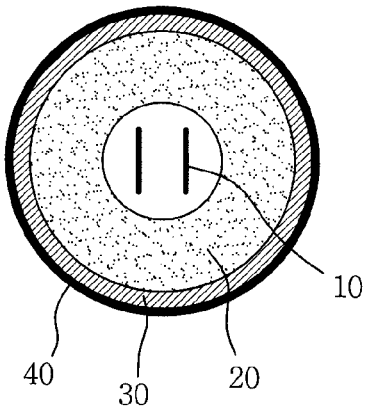
FIG. 3 is a cross-sectional view taken along the line A-A' of FIG. 2.

FIG. 2 is a perspective view illustrating a ceramic-coated heater for enabling the combined use in water and air according to the present invention, and FIG. 3 is a cross-sectional view taken along the line A-A' of FIG. 2.

Although an example of a bar-shaped heater having the simplest constructions of the heaters has been described for the purpose of helping to understand the present invention in the accompanying drawings, heaters of various shapes can be applied to the present invention, and thus the shape of the heater has no connection with the characteristics of the present invention and the present invention is characterized in a ceramic composition coated on the outer surface of the heater.

The present invention is directed to a ceramic-coated heater for enabling the combined use in water and air, in which a heater rod has a ceramic coating layer formed on the outer surface thereof, the ceramic coating layer being coated with a ceramic coating composition, wherein the ceramic coating composition contains:

65 to 80 parts by weight of a binder consisting essentially of a silane compound and a silica sol;

18 to 30 parts by weight of a ceramic powder obtained by mixing a high thermal conductive ceramic and a far infrared ray-radiating ceramic;

1 to 3 parts by weight of an acrylic corrosion resistant wax; and 1 to 2 parts by weight of a pigment, wherein the parts by weight are based on 100 parts by weight of the composition.

The heater 100 applied to the present invention is a heater having a typical structure as shown in FIGS. 2 and 3. A heater rod of the heater 100 includes a nicrome wire coil 10 which is disposed in the central portion thereof and through which current flows, a thermal conductivity insulator 20 configured to surround the outer circumference of the central portion of the heater rod, and a conductor 30 configured to surround the outer circumference of the thermal conductivity insulator 20 and made of a material such as steel sheet, stainless steel, and the like having a function of emitting heat to a medium such as water or air. The thermal conductivity insulator 20 transfers only heat generated from the nicrome wire coil 10 to the conductor 30 and blocks current flowing through the nicrome wire coil 10 from being transferred to the conductor 30.

In addition, the heater rod fixed by a fixed plate 50 to which a temperature sensor (not shown) and a positive potential terminal 70 are attached is coupled to an inner wall of a heating apparatus.

Further, the heater having the above structure applies a positive (+) DC potential to the conductor 30 through the positive potential terminal 70, and applies a negative (−) potential to water to cause the flow of a weak current of from 10 mA to 300 mA, thereby preventing scales from being formed on the outer surface of the hater rod.

The ceramic-coated heater according to the present invention allows a ceramic coating layer 40 to be formed on the outer surface of the heater rod to improve the physical properties including heat resistance, corrosion resistance, wear resistance, and the like to enable the heater to be used in water. In addition, the film of the coating layer is not decomposed even when the heater is heated to a temperature of 260° C. or higher to heat air, Thus, the ceramic-coated heater according to the present invention features that it enables the combined use in water and air and thus the application of the heater to a variety of home appliances including a drum type washing machine, a steam iron, a heater, and the like, as well as improves thermal conductivity of the heater to reduce energy consumption.

The heater rod applicable in the present invention may be formed in various shapes including a bar shape, a helical shape, a corrugated shape, and the like.

Now, the components of a ceramic coating composition for coating the ceramic-coated heater according to the present invention will be described hereinafter in detail.

The ceramic coating composition in the present invention is an improvement of an inorganic ceramic coating composition for application to a heater, which is disclosed in Korean Patent Registration No. 512599 for which the present inventor has been granted a patent. The inventive ceramic coating composition consists of a binder, a ceramic powder, an acrylic corrosion resistant wax, and a pigment.

Also, the binder in the present invention is obtained by mixing a silane compound and a silica sol. The binder functions to improve the mechanical properties such as durability, wear resistance, and the like of the coating layer, and the chemical properties such as corrosion resistance.

The binder is preferably contained in an amount of 65 to 80 parts by weight based on 100 parts by weight of the ceramic coating composition.

If the content of the binder is less than 65 parts by weight, the mechanical and chemical properties may be deteriorated. On the contrary, if the content of the binder is more than 80 parts by weight, the mechanical and chemical properties is improved but thermal conductivity may be lowered.

In addition, the binder preferably consists of 50 to 70% by weight of a silane compound and 30 to 50% by weight of a silica sol, based on the total weight of the binder.

The silane compound is preferably a silane represented by the formula $RnSiX_{4-n}$ or an oligomer derived therefrom.

In this case, one or more silane are used. In the formula $RnSiX_{4-n}$, R denotes a hydrogen atom or an alkyl group having 10 or less carbon atoms, X denotes a hydrolyzable group or a hydroxyl group; and n denotes 0, 1 or 2, with the proviso that when n is 2, each R may be the same or different, and when (4-n) is 2 or more, each X may be the same or different.

More specifically, the silane compound preferably uses one or more selected from the group consisting of methyltrimethoxysilane, ethyltrimethoxysilane, normalpropyltrimethoxysilane, phenylrimethoxysilane, vinyltrimethoxysilane, methyltriethoxysilane, ethyltriethoxysilane, normalpropyltriethoxysilane, phenylriethoxysilane, vinyltriethoxysilane, fluoropropyltrimethoxysilane, tridecafluorooctyltrimethoxysilane, tetraethoxysilane, and heptadecafluorodecyltrimethoxysilane.

Moreover, if the content of the silane compound is less than a limited range, its reactivity with the silica sol may be decreased. Contrarily, if the content of the silane compound exceeds the limited range, an excessive reaction may occur to cause a risk of deteriorating the physical properties of the binder.

In addition, the silica sol is an inorganic compound which binds with the silane compound through a chemical reaction, and is preferably contained in an amount of 30 to 50% by weight based on the total weight of the binder. If the content of the silica sol is beyond the limited range, the bonding force of silicon (Si)-oxygen (O)-metal between methyltrimethoxysilane and tetraethoxysilane may be weakened, thereby leading to a risk of occurrence of a phenomenon in which the silica sol is peeled off from the ceramic coating layer at high temperature.

In addition, the silica sol used in the present invention is preferably obtained by mixing 60 to 80% by weight of water and 20 to 40% by weight of a powder silicon oxide ($SiO_2$) having a particle size of from 0.2 to 1.0 μm, based on the total weight of the silica sol. The contents of water and powder silicon oxide contained in the silica sol can be adjusted properly, if necessary.

Also, the ceramic powder used in the present invention is obtained by mixing 50 to 60% by weight of a high thermal conductive ceramic and 40 to 50% by weight of a far infrared ray-radiating ceramic, based on the total weight of the ceramic powder.

Further, the ceramic powder is preferably contained in an amount of 18 to 30 parts by weight based on 100 parts by weight of the ceramic coating composition. If the content of the ceramic powder is less than 18 parts by weight, the efficiencies of wear resistance, thermal conductivity, and the like may be decreased. On the contrary, if the content of the ceramic powder exceeds 30 parts by weight, the ceramic powder may be contained in a relatively excessive amount as compared to the binder, thereby leading to a risk of weakening the bonding force of the ceramic coating layer film.

In the present invention, the high thermal conductive ceramic functions to improve the physical properties such as wear resistance, and the like along with high thermal conductivity. The high thermal conductive ceramic preferably uses one or more selected from the group consisting of boron nitrate, β-alumina, and zirconia as compounds having a high thermal conductivity.

In addition, the far infrared ray-radiating ceramic functions to improve heat efficiency through the emission of far infrared rays and enhance the mechanical properties such as wear resistance. The far infrared ray-radiating ceramic preferably uses one or more selected from the group consisting of tourmaline, red clay, sericite, obsidian, elvan, which has a far infrared ray emissivity of more than 90% at 40° C.

If the contents of the high thermal conductive ceramic and the far infrared ray-radiating ceramic contained in the ceramic powder are beyond the limited range, the balance ratio between the amount of heat supplied and the amount of far infrared ray radiation may not be adjusted properly, thereby leading to a degradation of heat efficiency.

In addition, the ceramic powder used in the present invention preferably has a particle size of from 0.2 to 1.0 μm. If the particle size of the ceramic powder is less than the limited range, there is a risk of occurrence of a non-economic problem due to an increase in the material cost. On the other hand, if the particle size of the ceramic powder exceeds the limited range, the surface of the coating layer film will not be smooth.

Further, in the present invention, the acrylic corrosion resistant wax is added to improve corrosion resistance and heat resistance, and functions to strengthen the bonding force of the coating layer film, thus improving the physical properties thereof including heat resistance, corrosion resistance, and the like to enable the heater to be used in water. In addition, the film of the coating layer is not decomposed even when the heater is heated to a temperature of 260° C. or higher to heat air, thereby enabling the combined use in water and air Preferably, the acrylic corrosion resistant wax is contained in an amount of 1 to 3 parts by weight based on 100 parts by weight of the ceramic coating composition. If the content of the acrylic corrosion resistant wax is less than 1 part by weight, the physical properties such as heat resistance, corrosion resistance, and the like of the coating layer film may be decreased. On the contrary, if the content of the acrylic corrosion resistant wax exceeds 3 parts by weight, other physical properties of the coating layer film or the bonding force of the coating layer film may be lowered.

In addition, the acrylic corrosion resistant wax is a non-fluorinated corrosion resistant wax, and preferably contains 80 to 90% by weight of an acrylic copolymer emulsion, 3 to 5% by weight of a paraffin wax, and 7 to 15% by weight of a xylene based on the total weight of acrylic corrosion resistant wax.

If the content of the acrylic copolymer emulsion is less than the limited range, corrosion resistance and heat resistance may be deteriorated. Contrarily, if the content of the acrylic copolymer emulsion exceeds the limited range, the contents of the paraffin wax or the xylene may be relatively decreased, and thus the acrylic corrosion resistant wax may be not uniformly mixed with the ceramic powder, thereby leading to a decrease in corrosion resistance and heat resistance.

Further, the acrylic copolymer emulsion consists of 100 parts by weight of an acrylic copolymer, 50 to 500 parts by weight of water, and 0.5 to 20 parts by weight of a nonionic surfactant.

Also, the acrylic copolymer is preferably a block copolymer having the structure A1-B-A2, and polymer blocks A1 and A2 includes methylmethacrylate, methylmethacrylate, n-propylmethacrylate, isobutylmethacrylate, isobornylacrylate, isobornylmethacrylate, t-butylmethacrylate, cyclohexylmethacrylate, and a combination thereof, i.e., a polymer or a copolymer derived from an acrylic or methacrylic acid alkyl ester monomer.

In addition, a polymer block B includes methylacrylate, ethylacrylate, n-propylacrylate, isobutylacrylate, n-butylacrylate, sec-butylacrylate, t-butylacrylate, amylacrylate, isoamylacrylate, n-hexylacrylate, 2-ethylhexylacrylate, laurylacrylate, isooctylacrylate, decylmethylacrylate, and a combination thereof, i.e., a polymer or a copolymer derived from an acrylic or methacrylic acid alkyl ester monomer.

Also, the ceramic coating composition contains a pigment to represent the color of the coating film. Preferably, the pigment is contained in an amount of 1 to 2 parts by weight based on 100 parts by weight of the ceramic coating composition. Although the content of the pigment has been limited above, it is not limited to the above predetermined range but may be properly adjusted by saturation, brightness, and the like of the pigment depending on the color of the pigment, the demand of a consumer, or the need of a manufacturer.

In the present invention, the ceramic coating layer preferably has a thickness of from 20 to 50 μm. If the thickness of the ceramic coating layer is less than 20 μm, the mechanical properties such as durability and wear resistance and the chemical properties such as corrosion resistance may be deteriorated. On the other hand, if the thickness of the ceramic coating layer exceeds 50 μm, the mechanical and chemical properties are improved but the thermal conductivity may be lowered.

As described above, according to the present invention, the outer surface of the heater rod is coated with a ceramic composition in which an acrylic resin and a high thermal conductive ceramic is mixed with each other, thereby strengthening the bonding force of the coating layer film, and thus improving the physical properties thereof including heat resistance, corrosion resistance, wear resistance, and the like. In addition, thermal conductivity is increased, thereby enabling the combined use in water and air and thus the application of the heater to a variety of home appliances including a drum type washing machine, a steam iron, a heater, and the like. Thus, it is expected that the demand of the heater would be increased.

The construction of the present will be described hereinafter in more detail by way of examples. It should be appreciated that these examples are provided to assist understanding and illustration of the present invention only and should not be construed as intending to limit the scope of the present invention.

1. Manufacture of Heater Rod Sample of Ceramic-Coated Heater

A ceramic coating layer having a film thickness of 25±5 μm was formed on a heater having a shape as shown in FIG. 2 using a ceramic coating composition according to Examples 1 and 2, and Comparative Examples 1 and 2 to manufacture a sample (sus 24) of a conductor of a heater rod of the heater.

EXAMPLE 1

A sample of the heater rod was manufactured by the above method 1 using a ceramic coating composition which contains: 65 parts by weight of a binder obtained by mixing 50% by weight of a silane compound in which methyltrimethoxysilane and tetraethoxysilane are mixed uniformly with 50% by weight of silica sol; 30 parts by weight of a ceramic powder obtained by mixing 50% by weight of a high thermal conductive ceramic in which boron nitrate, β-alumina, and zirconia are mixed uniformly with 50% by weight of a far infrared ray-radiating ceramic in which tourmaline, red clay, sericite, obsidian, and elvan are mixed uniformly; 3 parts by weight of an acrylic corrosion resistant wax; and 2 parts by weight of a pigment.

The silica sol was obtained by adding 80% by weight of water to 20% by weight of a powder silicon oxide ($SiO_2$)

EXAMPLE 2

A sample of the heater rod was manufactured by the above method 1 using a ceramic coating composition which contains: 80 parts by weight of a binder obtained by mixing 70% by weight of a silane compound in which methyltrimethoxysilane and tetraethoxysilane are mixed uniformly with 30% by weight of silica sol; 18 parts by weight of a ceramic powder obtained by mixing 60% by weight of a high thermal conductive ceramic in which boron nitrate, β-alumina, and zirconia are mixed uniformly with 40% by weight of a far infrared ray-radiating ceramic in which tourmaline, red clay, sericite, obsidian, and elvan are mixed uniformly; 1 part by weight of an acrylic corrosion resistant wax; and 1 parts by weight of a pigment.

The silica sol was obtained by adding 40% by weight of water to 60% by weight of a powder silicon oxide ($SiO_2$)

COMPARATIVE EXAMPLE 1

A sample of the heater rod was manufactured using 3 parts by weight of fluorine resin as a substitute for the acrylic corrosion resistant wax while coating the heater rod of the heater with ceramic by the same method as that in Example 1.

The binder, the silica sol, and the ceramic powder used a compound having the same composition ratio as that in Example 1.

COMPARATIVE EXAMPLE 2

A sample of the heater rod was manufactured by the above method 1 using a ceramic coating composition which contains: 80 parts by weight of a binder; 18 parts by weight of a ceramic powder; 1 part by weight of an acrylic corrosion resistant wax; and 1 part by weight of a pigment.

The binder used a compound having the same composition ratio as that in Example 1, and the ceramic powder used only the far infrared ray-radiating ceramic.

2. Evaluation of Heater Rod Sample of Ceramic-Coated Heater Ceramic

An evaluation was made on the heater rod sample manufactured by the method of Examples 1 and 2 and Comparative Examples 1 and 2 in terms of corrosion resistance, heat resistance, and thermal conductivity. A result of the evaluation result is listed in Table 1 below.

TABLE 1

| Evaluation | Examples | | Comparative Examples | |
|---|---|---|---|---|
| items | 1 | 2 | 1 | 2 |
| corrosion resistance | good | good | good | good |
| heat resistance | good | good | Partially decomposed | good |
| thermal conductivity (W/mk) | 2.631 | 2.212 | 0.812 | 1.415 |

The corrosion resistance in the evaluation items of Table 1 was evaluated in such a manner that after a heater rod sample was immersed in an NaCl aqueous solution for 60 days, a coating layer film was observed. The heat resistance was evaluated in such a manner that the heater rod sample was heated to a temperature of 300° C., and then a coating layer film was observed after 2 hours. In addition, the thermal conductivity followed a result of the evaluation performed in the Korea Advanced Institute of Science and Technology (KAIST).

According to the content of Table 1, it could be found that Examples 1 and 2 were more excellent than Comparative Examples 1 and 2 in terms of performances of corrosion resistance, heat resistance, and thermal conductivity so that the ceramic-coated heater enables the combined use in water and air.

On the other hand, in Comparative Example 1, fluorine resin was used as a substitute for the acrylic corrosion resistant wax used in Examples 1 and 2. As a result, it could be found that the physical properties of corrosion resistance was satisfied but the performance of heat resistance and thermal conductivity was lowered, making it difficult for the heater to be used in the air. In case of Comparative Example 2, corrosion resistance and heat resistance were good but the physical properties of thermal conductivity were lowered. As a result, it was evaluated that performance of thermal conductivity in Comparative Example 2 is lower than that in Examples 1 and 2 and Comparative Example 1.

Therefore, as discussed in above Examples, although the ceramic-coated heater for enabling the combined use in water and air according to the present invention has been proved to be excellent, it will be apparent to those skilled in the art that the construction of the present invention is not limited by these examples but various substitutions and modifications of these examples can be made without departing from the technical spirit and scope of the present invention.

MODE FOR INVENTION

To achieve the above objects, in one aspect, the present invention provides a ceramic-coated heater for enabling the combined use in water and air, in which a heater rod has a ceramic coating layer formed on the outer surface thereof, the ceramic coating layer being coated with a ceramic coating composition, wherein the ceramic coating composition contains:

65 to 80 parts by weight of a binder consisting essentially of a silane compound and a silica sol;

18 to 30 parts by weight of a ceramic powder obtained by mixing a high thermal conductive ceramic and a far infrared ray-radiating ceramic;

1 to 3 parts by weight of an acrylic corrosion resistant wax; and 1 to 2 parts by weight of a pigment, wherein the parts by weight are based on 100 parts by weight of the composition.

Preferably, the binder consists of 50 to 70% by weight of a silane compound and 30 to 50% by weight of a silica sol, based on the total weight of the binder. Also, preferably, the silane compound is a binding agent for binding the ceramic powder, which is a silane represented by the formula $RnSiX_{4-n}$ or an oligomer derived therefrom.

In addition, preferably, the silica sol is a mixture obtained by adding a 60 to 80% by weight of water to 20 to 40% by weight of a powder silicon oxide having a particle size of from 0.2 to 1.0 μm.

Further, preferably, the ceramic powder is obtained by mixing 50 to 60% by weight of a high thermal conductive ceramic and 40 to 50% by weight of a far infrared ray-radiating ceramic, based on the total weight of the ceramic powder.

Industrial Applicability

The ceramic coated heater according to the present invention enables the combined use in water and air and thus the application of the heater to a variety of home appliances including a drum type washing machine, a steam iron, a heater, and the like. In addition, the inventive ceramic coated heater improves thermal conductivity and wear resistance to enable high thermal conductivity using less current and reduce energy consumption. Therefore, the ceramic-coated heater of the present invention is expected to be utilized in a wide variety of industrial fields.

The invention claimed is:

1. A ceramic-coated heater for the combined use in water and air, in which a heater rod has a ceramic coating layer formed on the outer surface thereof, the ceramic coating layer being coated with a ceramic coating composition, wherein the ceramic coating composition comprises:

65 to 80 parts by weight of a binder consisting essentially of 50 to 70% by weight of a silane compound and 30 to 50% by weight of a silica sol;

18 to 30 parts by weight of a ceramic powder obtained by mixing a high thermal conductive ceramic and a far infrared ray-radiating ceramic;

1 to 3 parts by weight of an acrylic corrosion resistant wax; and 1 to 2 parts by weight of a pigment, wherein the silica sol is obtained by mixing 60 to 80% by weight of water and 20 to 40% by weight of a powder silicon oxide ($SiO_2$) having a particle size of from 0.2 to 1.0 μm, based on the total weight of the silica sol, wherein the ceramic powder is obtained by mixing 50 to 60% by weight of a high thermal conductive ceramic and 40 to 50% by weight of a far infrared ray-radiating ceramic, based on the total weight of the ceramic powder, wherein the acrylic corrosion resistant wax consists of 80 to 90% by weight of an acrylic copolymer emulsion, 3 to 5% by weight of a paraffin wax, and 7 to 15% by weight of a xylene based on the total weight of acrylic corrosion resistant wax, wherein the acrylic copolymer emulsion consists of 100 parts by weight of an acrylic copolymer, 50 to 500 parts by weight of water, and 0.5 to 20 parts by weight of a nonionic surfactant, wherein the silane compound is a silane or on oligomer derived therefrom, the silane being represented the formula $R_nSiX_{4-n}$ where R denotes a hydrogen atom or an alkyl group having 10 or less carbon atoms; X denotes a hydrolyzable group or a hydroxyl group; and n denotes 0, 1 or 2, and wherein the high thermal conductive ceramic uses one or more selected from the group consisting of boron nitrate, β-alumina, and zirconia as compounds having a high thermal conductivity.

2. The ceramic-coated heater according to claim 1, wherein the far infrared ray-radiating ceramic uses one or more selected from the group consisting of tourmaline, red clay, sericite, obsidian, elvan.

* * * * *